US007293491B2

(12) United States Patent
Harfst et al.

(10) Patent No.: US 7,293,491 B2
(45) Date of Patent: Nov. 13, 2007

(54) LOW VIBRATION SAW CHAIN

(75) Inventors: Mike Harfst, Milwaukie, OR (US); Arlan Way, Gladstone, OR (US); Chris Seigneur, West Linn, OR (US); George Carruthers, deceased, late of Niveues (BE); by Sandra Caruthers, legal representative, Niveues (BE)

(73) Assignee: Blount, Inc., Portland, OR (US)

( * ) Notice: Subject to any disclaimer, the term of this patent is extended or adjusted under 35 U.S.C. 154(b) by 0 days.

(21) Appl. No.: 11/256,628

(22) Filed: Oct. 21, 2005

(65) Prior Publication Data

US 2007/0089586 A1 Apr. 26, 2007

(51) Int. Cl.
*B27B 33/02* (2006.01)
*B27B 33/14* (2006.01)

(52) U.S. Cl. ..... 83/830; 30/381

(58) Field of Classification Search ..... 83/830, 83/831, 832, 833, 834; 30/381
See application file for complete search history.

(56) References Cited

U.S. PATENT DOCUMENTS

| | | | | |
|---|---|---|---|---|
| 2,391,286 | A * | 12/1945 | Wolf | 30/383 |
| 2,902,068 | A * | 9/1959 | Gudmundsen | 83/834 |
| 4,625,610 | A * | 12/1986 | Petrovich | 83/834 |
| 5,092,211 | A * | 3/1992 | Petrovich et al. | 83/830 |
| 5,172,619 | A * | 12/1992 | Kolve | 83/13 |
| 6,435,070 | B1 * | 8/2002 | Weber | 83/834 |

* cited by examiner

*Primary Examiner*—Kenneth E. Peterson
*Assistant Examiner*—Sean Michalski
(74) *Attorney, Agent, or Firm*—Schwabe, Williamson & Wyatt

(57) ABSTRACT

A saw chain is provided that has a plurality of cutter links coupled to an opposing tie strap, where the cutter link has a portion that protrudes past the tie strap to enable pivotal movement of the cutter link toward a central longitudinal axis of a guide bar.

19 Claims, 3 Drawing Sheets

LOW VIBRATION SAW CHAIN

FIELD

Embodiments of the invention relate generally to the field of saw chains, and more particularly to a saw chain configured to reduce vibration.

BACKGROUND

Saw chains may experience excess vibration, which can be translated to a user. Such vibrations may be caused by a variety of factors, including when the cutter link contacts a portion of an article to be cut that is harder than the surrounding portions. Attempts have been made to minimize vibration. These attempts have focused on using a cutter link and tie strap configuration that allows the cutter links to rock rearwardly in a direction longitudinal to a longitudinal axis of the saw bar.

BRIEF DESCRIPTION OF THE DRAWINGS

Embodiments of the invention are illustrated by way of example and not by way of limitation in the figures of the accompanying drawings, in which like references indicate similar elements and in which.

DETAILED DESCRIPTION

Various aspects of the illustrative embodiments will be described using terms commonly employed by those skilled in the art to convey the substance of their work to others skilled in the art. However, it will be apparent to those skilled in the art that alternate embodiments may be practiced with only some of the described aspects. For purposes of explanation, specific materials and configurations are set forth in order to provide a thorough understanding of the illustrative embodiments. However, it will be apparent to one skilled in the art that alternate embodiments may be practiced without the specific details. In other instances, well-known features are omitted or simplified in order not to obscure the illustrative embodiments.

Further, various operations will be described as multiple discrete operations, in turn, in a manner that is most helpful in understanding the present invention; however, the order of description should not be construed as to imply that these operations are necessarily order dependent. In particular, these operations need not be performed in the order of presentation.

The phrase "in one embodiment" may be used repeatedly. The phrase generally does not refer to the same embodiment; however, it may. The terms "comprising," "having," and "including" are synonymous, unless the context dictates otherwise.

Embodiments of the present invention may include a saw chain having cutter links that are configured to allow slight lateral pivoting or rotation in order to allow the cutting tooth to react to various cutting conditions and reduce vibration caused by the saw chain. Embodiments may also include cutter links that have an extended or an exposed toe portion adapted to ride on a rail of a guide bar such that rearward and laterally rotative movement may be allowed.

Figure 1:
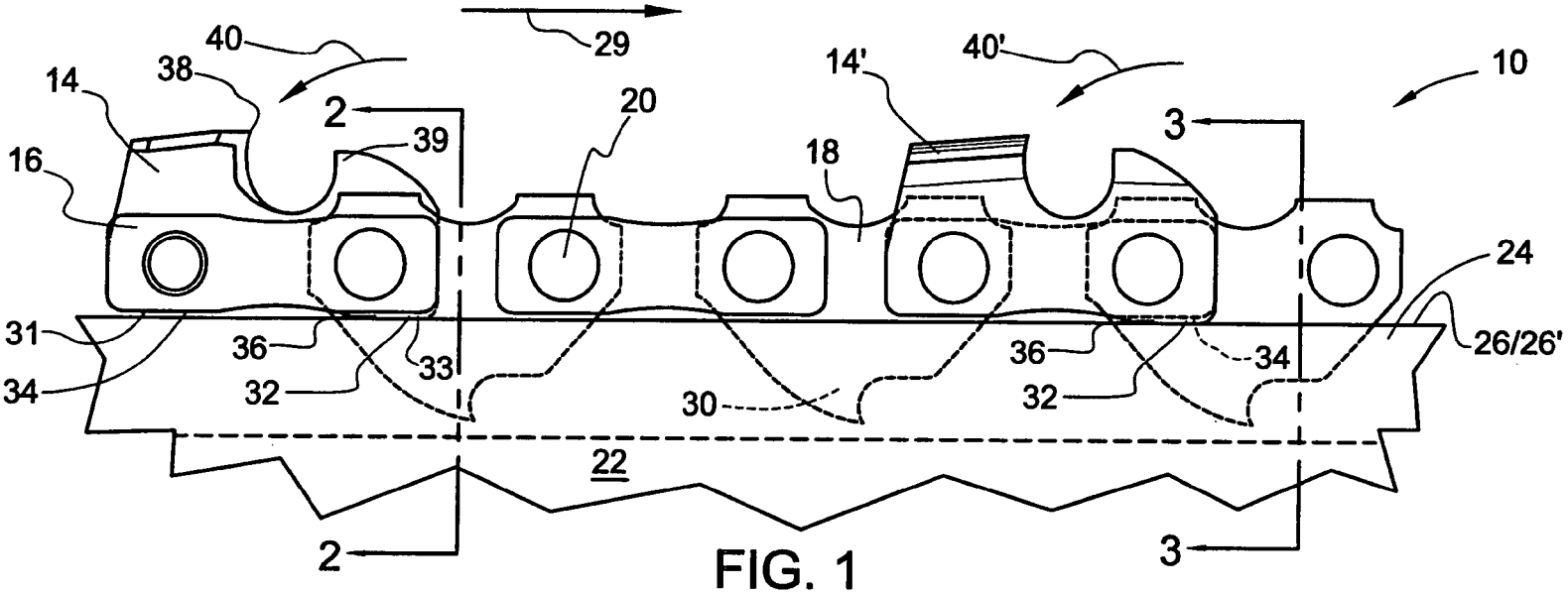
FIG. 1 illustrates a side view of a saw chain in accordance with an embodiment of the present invention.
Figure 3:
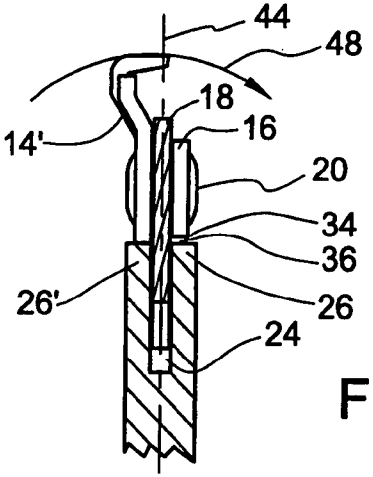
FIG. 3 illustrates a cross sectional view of a saw chain, taken along the line 3-3, in accordance with an embodiment of the present invention.
Figure 2:
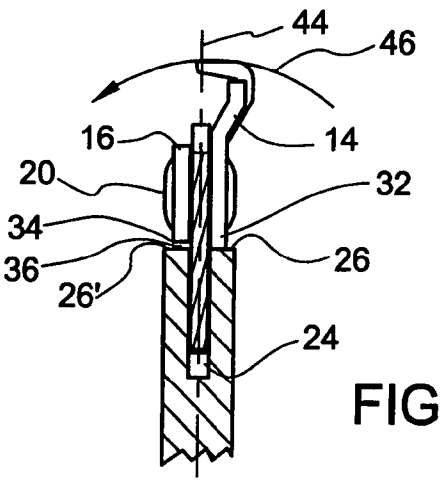
FIG. 2 illustrates a cross sectional view of a saw chain, taken along the line 2-2, in accordance with an embodiment of the present invention.
Figure 4:
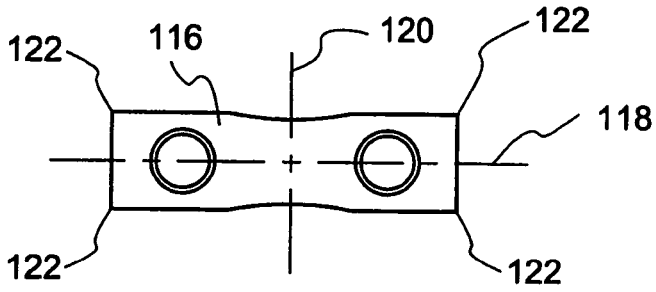
FIG. 4 illustrates a side view of a tie strap in accordance with an embodiment of the present invention.
Figure 5:
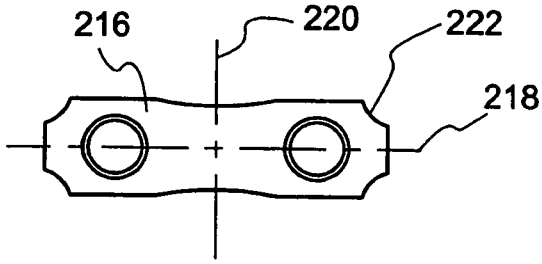
FIG. 5 illustrates a side view of a tie strap in accordance with an embodiment of the present invention.
Figure 6:
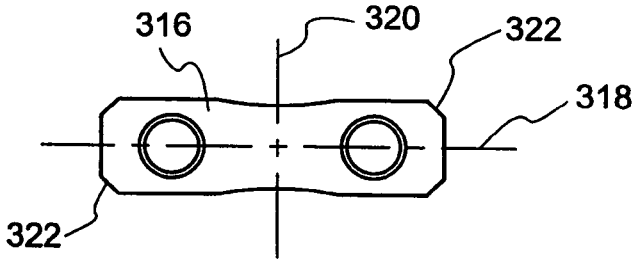
FIG. 6 illustrates a side view of a tie strap device in accordance with an embodiment of the present invention.
Figure 7:
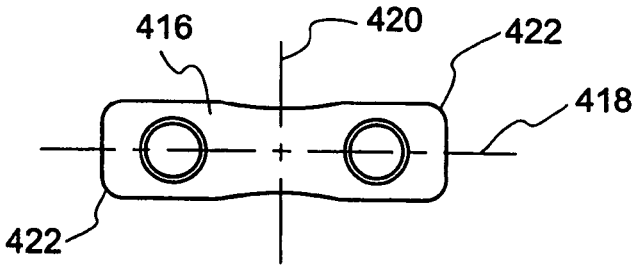
FIG. 7 illustrates a side view of a tie strap in accordance with an embodiment of the present invention.

FIG. 1 is a side view of a saw chain in accordance with embodiments of the present invention. FIG. 2 and FIG. 3 are cross sectional views taken at 2-2 and 3-3 respectively of the saw chain in FIG. 1 in accordance with an embodiment of the invention. In the illustrated embodiment, a section of a saw chain 10 is shown and includes cutter links 14 and 14' and drive links 18. Drive links 18 may be coupled to other drive links 18 or cutter links 14 and 14' via tie straps 16 and rivets 20.

Saw chain 10 may be adapted to engage a groove or guide 24 of a guide bar 22. Guide 24 may be defined on the outward portion by a pair of rails 26 and 26' that are spaced apart a sufficient distance to accommodate the width of drive tangs 30 of drive links 18, and enable the saw chain 10 to traverse the guide bar 22 in a cutting operation. The saw chain may be adapted to travel in a direction as indicated with arrow 29.

In one embodiment, cutter links 14/14' are virtually identical in structure, except one may be a right-hand cutter link and the other the left-hand cutter link. Accordingly, only one cutter link will be discussed with respect to various embodiments, but the disclosed concepts may apply to both cutter links. Cutter links 14 may include an upper portion that has a cutting edge 38 and a depth gage 39 configured to control a depth of cut. In one embodiment, cutter links 14 may also include a lower portion having a heel portion 31 and a toe portion 33. Toe portion 33 may include a protrusion 32 that is adapted to extend below a bottom surface 34 of a corresponding tie strap 16 positioned opposite the cutter links 14.

Protrusion 32 of cutter link 14 may be adapted to be in sliding engagement with rail 26. Protrusion 32 may be further adapted to guide and support the saw chain 10 as it traverses the guide bar 22. The tie strap 16 opposite the cutter link 14 may be sized such that a gap 36 is defined between the bottom surface 34 of the tie strap 16 and the opposite track rail 26', such that the protrusion 32 is the primary point of normal engagement between the saw chain and the guide bar 22.

In one embodiment, upon making contact with an article to cut, in particular a portion of the article which may be harder or more resistant to cutting, the cutter link 14 may be allowed to pivot about the protrusion 32 in the rearward direction, as illustrated by arrow 40. The gap 36 defined between the tie strap 16 and the rail 26', opposite the protrusion 32 on the cutter link 14 may allow the cutter link 14 to also pivot laterally toward a central axis 44, as illustrated by arrow 46. Similarly the cutter link 14' may, upon making contact with an object, pivot in a direction as illustrated by arrow 40', and as illustrated in FIG. 3, pivot laterally in a direction toward the central axis 44 as illustrated by arrow 48. It will be understood, the phrase "toward the central axis" may also refer to portions of the cutter links 14, 14' that are passed and may have moved passed the central axis 44 in the directions illustrated with arrows 46 and 48.

The lateral pivot or rotation of the cutter link 14 may serve to help absorb the impact of a cutter tooth on a resistive material, which in turn may serve to reduce vibration of a saw. Alternate cutter links 14, 14' etc. may be disposed on opposite sides of a saw chain according to various embodiments of the invention, and may be configured to pivot laterally in alternately opposite directions. The alternating pivoting movement may serve to maintain straight cuts. The lateral pivoting may also serve to provide a narrower kerf and promote more efficient and reduced vibration cutting operation.

In various embodiments of the present invention, the protrusion 32 may be configured to extend below the bottom surface 34 of the tie straps 16 by, for example, limiting the vertical extension of the tie straps 16. One such way of limiting the vertical extension may be, for example, relieving or cutting each tie strap along a bottom edge thereof. Such a configuration may be described as an "in pitch" configuration, in that the centers of the rivet holes of the cutter links 14 may be positioned a standard pitch distance from a center line of the guide bar 22, i.e. the pitch defined by a drive sprocket.

In other embodiments, the cutter links 14 may be configured to have a protrusion that extends below the bottom surface of an otherwise "standard" tie strap 16. Such a configuration may be defined as "over pitch" in that the toe side rivet hole at the cutter link 14 may be configured to "ride" over a pitch distance from the center of the guide bar 22. Embodiments configured with an over pitch design may provide a longer service life.

FIGS. 4-7 illustrate side views of tie straps in accordance with embodiments of the invention. The tie straps 116, 216, 316, and 416 may be used in conjunction with a standard cutter link to maintain an in pitch configuration, in that they have slightly relieved top and bottom surfaces to allow the toe portion of a cutter link to (not shown) protrude below such surfaces. The tie straps 116, 216, 316, and 416 may be configured to be symmetrical about a horizontal axis 118, 218, 318, and 418, and about a vertical axis 120, 220, 320, and 420. Such symmetry may make the tie straps 116, 216, 316, and 416 well suited for manufacturability in that the orientation of the tie strap upon assembling, may be as shown, or may be upside down, or the front and back surfaces may be reversed. The symmetrical configuration may also benefit the end user in that orientation of the tie straps will be irrelevant during saw chain maintenance.

In one embodiment, the tie strap 116 may have generally square corners 122, which may add to the ease of manufacturability and may also add to the vibration reducing characteristics. In one embodiment, each of the four corners 222 of the tie strap 216 have been given a so-called "VA trim" configuration. This embodiment may also lend itself to ease of manufacture, and reduce material waste. The tie strap 316 may have chamfered corners 322, which may also reduce vibration and improve performance. The tie strap 416 may include filleted corners 422. Other relieved tie strap configurations may be used in other embodiments according the invention.

Figure 8:
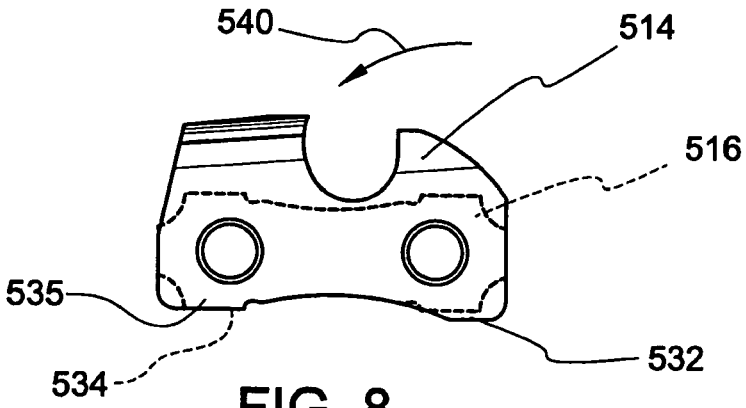
FIG. 8 illustrates a side view of a cutter link in accordance with an embodiment of the present invention.

FIG. 8 illustrates a side view of a cutter link 514 in accordance with an embodiment of the invention. A tie strap 516 is shown in dotted line and is superimposed over the cutter link 514. The tie strap may be a "standard" tie strap in that its size is not necessarily varied, i.e., clipped, cut, or otherwise formed differently. Cutter link 514 may have a portion of the toe that is slightly extended such that it has a protrusion 532 that extends below a bottom edge 534 of the tie strap 516. The heel portion 535 of the cutter link may be adapted to be roughly coplanar with the bottom surface of a rear portion 534 of tie strap 514. Saw chains using cutter links in accordance with the illustrated embodiment may result in an over pitch configuration. The cutter link 514 may be configured to pivot about the protrusion 532 in a direction illustrated with arrow 540. The cutter link may also pivot laterally similar to the pivot illustrated with arrow 48 in FIG. 3.

Figure 9:
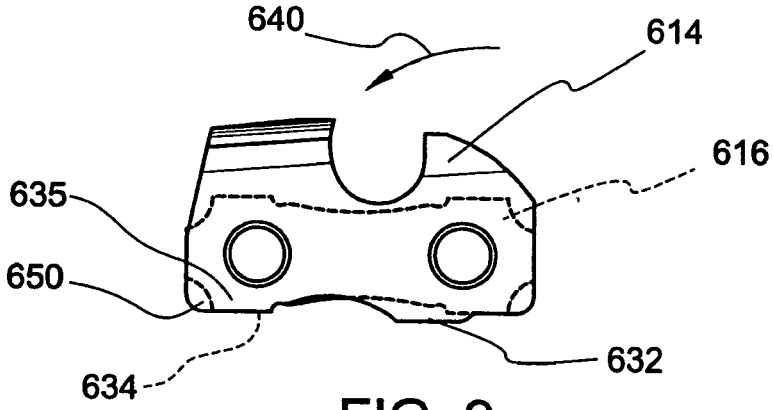
FIG. 9 illustrates a side view of a cutter link in accordance with an embodiment of the present invention.

FIG. 9 illustrates a side view of a cutter link 614 in accordance with an embodiment of the invention. A standard tie strap 616 may be used and is shown in dotted line and is superimposed over the cutter link 614. Cutter link 614 may have a portion of the toe that is slightly extended such that it has a protrusion 632 that extends below a bottom edge 634 of the tie strap 616. The heel portion 635 of the cutter link 614 may be adapted to be roughly coplanar with the bottom surface of a rear portion 634 of tie strap 616. The protrusion 632 may be closer to the heel end 650 of the cutter link and may allow pivoting in a direction illustrated with arrow 640, and also pivot laterally similar to the pivot illustrated with arrow 48 in FIG. 3. With the protrusion positioned rearward of the toe, some forward movement may also be possible.

Figure 10:
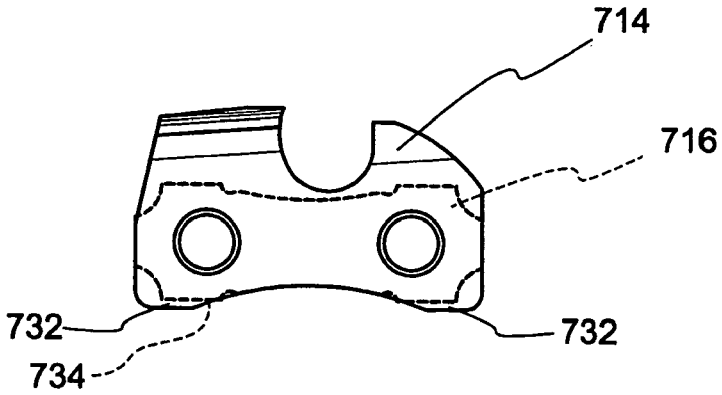
FIG. 10 illustrates a side view of a cutter link in accordance with an embodiment of the present invention.

FIG. 10 illustrates a side view of a cutter link 714 in accordance with an embodiment of the invention. A standard tie strap 716 may be used and is shown in dotted line superimposed over the cutter link 714. Two protrusions 732 may be positioned toward the toe and heel of the cutter link and both may extend below a bottom edge 734 of the tie strap 716. The protrusions 732 may not allow for much or any longitudinal pivoting, but may still allow lateral pivoting similar to that shown with arrow 48 shown in FIG. 3. Various embodiments may include a standard tie strap 716, and a cutter link 714 having an extended heel 732 and toe 732. Other embodiments according the invention may use a tie strap with a modified geometry, such as a clipped tie strap configured to expose a bottom edge of the cutter link.

A method according to embodiments of the invention and according to the various illustrated embodiments, may include:

coupling a cutter link to a tie strap to be located on opposite sides of a central axis of a guide bar, the cutter link having a cutting edge adapted for cutting a kerf, and having a bottom having a heal portion and a toe portion; and configuring the cutter link and the tie strap such that the bottom of the cutter link extends below a bottom edge of the tie strap.

The method may further include interlinking a plurality of the cutter links to a plurality of the tie straps, the tie straps being symmetrical about a horizontal axis such that they may be interlinked in multiple orientations while still allowing the bottom of the cutter link to extend below the tie strap.

The method may further include using standard cutter links with tie straps adapted to allow a portion of the toe of the cutter link to protrude past the bottom surface of the tie strap and slidingly engage the rail of a guide bar.

The method may further include using standard tie straps and cutter links having an extended portion of the toe such that the extended portion protrudes past the bottom surface of the tie strap and slidingly engages the rail of a guide bar.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiment shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

What is claimed is:

1. A saw chain for use on a chain saw having a guide bar, the guide bar having two rails of substantially equal height comprising:

a cutter link coupled to an opposing tie strap and adapted to traverse one of the guide bar rails of the guide bar along opposite sides of a longitudinal axis of the guide bar; and a rail engaging portion on the cutter link adapted to extend below a lowermost surface of the opposing tie strap and contacting the guide bar rail when in an operative position and disposed on one side of the longitudinal axis of the guide bar such that the cutter link can pivot laterally about the rail engaging portion toward the longitudinal axis and wherein the lowermost surface is disposed to move closer to the guide bar rail upon the lateral pivoting each tie strap and respective cutter link pair being connected by two pivot connections.

2. The saw chain of claim 1 wherein the lowermost surface of the tie strap is disposed a first spaced apart distance from the guide bar rail.

3. The saw chain of claim 2 wherein a heel portion of the cutter link has the lowermost surface that is disposed a second spaced apart distance from the guide bar rail to allow for rearward pivotal movement of the cutter link.

4. The saw chain of claim 2 wherein the tie strap is symmetrical about a horizontal axis and vertical axis such that the tie strap would occupy substantially the same space if detached from the saw chain and rotated about an axis normal to and intersecting with both the horizontal and vertical axes and reattached, and/or if the tie strap is detached from the saw chain and flipped about the horizontal and/or flipped about the vertical axis and reattached to the saw chain.

5. The saw chain of claim 1 wherein the tie strap includes corners selected from the group consisting of:

square;

chamfered;

VA trim; and filleted.

6. The saw chain of claim 1 further comprising a plurality of alternating right-hand and left-hand cutter links each coupled to opposing tie straps and drive links disposed between the right-hand and left-hand cutter links, the rail engaging portions on each of the cutter links being configured to support and guide the saw chain along the guide bar rail.

7. The saw chain of claim 1 wherein the rail engaging portion is formed by extending a toe portion of the cutter link below the lowermost surface of the tie strap.

8. The saw chain of claim 1 wherein the rail engaging portion is disposed such that the cutter link is configured to pivot about an axis transverse to the longitudinal axis.

9. A saw chain for use on a chain saw having a guide bar, the guide bar having two rails of substantially equal height comprising:

a plurality of alternating cutter links interlinked with an arrangement of drive links and tie straps and configured to move along a groove and the rails of the guide bar, each of the plurality of cutter links being interlinked with one of the tie straps by two pivot points across from and on opposite sides of a longitudinal axis of the guide bar;

and a rail engaging portion on each cutter link adapted to extend below a lowermost surface of each of the opposing tie straps and adapted to slidingly engage alternate rails such that the cutter links can pivot laterally about respective rail engaging portions toward a longitudinal axis effecting a movement of the lowermost portion of the respective opposing tie strap toward the rail.

10. The saw chain of claim 9 wherein the drive links are configured to fit within a guide track on the guide bar and are configured to limit an amount of pivot of the cutter links.

11. The saw chain of claim 9 wherein the rail engaging portions are disposed such that the cutter link is adapted to pivot about an axis transverse to the longitudinal axis.

12. A method comprising:

interlinking a cutter link to an opposed tie strap by two pivot connections to be positioned opposing one another on generally opposite sides of a longitudinal axis of a guide bar, the cutter link having a top configured for cutting and having a bottom portion and adapted to ride on a guide bar rail; and configuring the cutter link and the tie strap such that the bottom portion of the cutter link extends below a lowermost edge of the tie strap to allow for lateral pivotal movement about the longitudinal axis of the guide bar.

13. The method of claim 12 further comprising: interlinking a plurality of the cutter links to a plurality of the tie straps, the tie straps being symmetrical about a horizontal and vertical axis such that they may be interlinked in multiple orientations.

14. The method of claim 12 wherein the configuring includes further configuring the cutter link to allow for pivotal movement transverse to the longitudinal axis of the guide bar.

15. The saw chain of claim 3, wherein the first spaced apart distance and the second spaced apart distance are substantially similar.

16. A saw chain comprising:

a cutter link having a rail engaging portion adapted to move along and substantially parallel with a first guide bar rail and having a first cutter link rivet hole and a second cutter link rivet hole, the rail engaging portion having a contact surface adapted to contact the first bar rail;

a tie strap having a lowermost surface in proximal to a second bar rail and adapted to move substantially parallel with the second bar rail, and having a first tie strap rivet hole and a second tie strap rivet hole;

first and second rivets disposed in the respective first and second cutter link rivet holes and first and second tie strap rivet holes to operatively couple the cutter link to the tie strap; and the contact surface of the rail engaging portion disposed a first distance from the closest of either of the first cutter link rivet hole or the second cutter link rivet hole, and the lowermost surface being a second distance from the closest of either of the first tie strap rivet hole or the second tie strap rivet hole, the first distance being greater than the second distance.

17. The saw chain of claim 16 wherein the first distance is measured in a direction normal to the surface of the first bar rail, and the second distance is measured in a direction normal to the surface of the second bar rail.

18. The saw chain of claim 16 wherein the lowermost surface can be anywhere along the bottom of the tie strap.

19. The saw chain of claim 16 wherein the contact surface of the rail engaging portion can be anywhere along the bottom of the cutter link.

* * * * *